United States Patent [19]

Baier

[11] 4,247,754

[45] Jan. 27, 1981

[54] APPARATUS FOR PERFORATING WEBS OF WRAPPING MATERIAL FOR ROD-SHAPED SMOKERS PRODUCTS

[75] Inventor: Anton Baier, Wentorf, Fed. Rep. of Germany

[73] Assignee: Hauni-Werke Körber & Co. KG., Hamburg, Fed. Rep. of Germany

[21] Appl. No.: 3,364

[22] Filed: Jan. 15, 1979

[30] Foreign Application Priority Data

Jan. 20, 1978 [DE] Fed. Rep. of Germany ..... 2802315

[51] Int. Cl.[3] ..... H05B 7/18

[52] U.S. Cl. ..... 219/384; 131/15 B

[58] Field of Search ..... 219/121 EB, 383, 384; 83/171.16, 365, 360; 313/149; 131/15 B

[56] References Cited

U.S. PATENT DOCUMENTS

| | | | |
|---|---|---|---|
| 2,372,508 | 3/1945 | Meaker | 219/384 |
| 3,475,591 | 10/1969 | Fujii et al. | 219/384 |
| 3,622,751 | 11/1971 | Larive | 219/384 |

*Primary Examiner*—Volodymyr Y. Mayewsky

*Attorney, Agent, or Firm*—Peter K. Kontler

[57] ABSTRACT

Apparatus for making holes in a running web of wrapping material for cigarettes or in a running web of uniting band material which connects filter plugs with plain cigarettes has one or more groups of series-connected electrode pairs whose electrodes are disposed at the opposite sides of the web. Several sources of high-voltage impulses transmit impulses seriatim to one electrode of the foremost electrode pair of each group whereby the resulting spark discharge across the gaps between the electrodes of each pair entails the formation of holes. The size and/or the number of holes can be varied in order to ensure that the permeability of each unit length of the web will equal or approximate a selected value, by changing the frequency of application of high-voltage impulses or by changing the number of series-connected electrode pairs. The polarity of impulses is reversed, either regularly or at random intervals, in order to remove scraps of paper which accumulate at the tips of the electrodes. The electrode pairs of each group are staggered, as considered transversely and/or in the longitudinal direction of the web.

14 Claims, 3 Drawing Figures

APPARATUS FOR PERFORATING WEBS OF WRAPPING MATERIAL FOR ROD-SHAPED SMOKERS PRODUCTS

BACKGROUND OF THE INVENTION

The present invention relates to apparatus for perforating webs of paper or other wrapping material which can be utilized in the manufacture of filter plugs, plain or filter tipped cigarettes, cigars, cigarillos and analogous rod-shaped articles which constitute or form part of smokers' products. More particularly, the invention relates to improvements in apparatus wherein a running web of cigarette paper or other wrapping material of cigarettes, filter plugs and/or the like is perforated by electric sparks which are discharged across the gaps between pairs of electrodes installed adjacent to the path of movement of the web and connected to a source of high-voltage impulses.

In the manufacture of so-called light cigarettes, the wrapper of the cigarette is formed with holes or perforations which admit cool atmospheric air into the column of tobacco smoke. The thus admitted air influences the nicotine- and/or the condensate-content of the smoke; therefore, such holes are indispensable in many brands of presently popular rod-shaped smokers' products. The holes can be made in the wrapper of the tobacco filler and/or in the uniting band which connects the tobacco filler with a simple or complex filter plug.

U.S. Pat. No. 3,475,591 granted on Oct. 28, 1969 to Fujii et al. discloses an apparatus which comprises a row of electrodes at one side of a running cigarette paper web. The electrodes are connected in parallel and are further connected with a source of high-voltage impulses. A single counterelectrode is installed at the other side of the path of movement of the web. When the electrodes receive an impulse, a spark discharge takes place between the electrodes and the counterelectrode whereby the electric sparks perforate the adjacent portions of the running web. Such apparatus exhibit the drawback that the holes are relatively small and that the cross-sectional areas of the holes are not uniform. Therefore, the rate at which atmospheric air is admitted into and is mixed with the column of tobacco smoke is likely to vary from cigarette to cigarette.

OBJECTS AND SUMMARY OF THE INVENTION

An object of the invention is to provide an apparatus which can provide a running web of cigarette paper or the like with holes of uniform cross-sectional area and which can be readily adjusted to make holes of desired diameter.

Another object of the invention is to provide a highly versatile perforting apparatus which can be used for the making of holes in all kinds of wrapping material for plain cigarettes, plain cigars, plain cigarillos, filter plugs or filter tipped smokers' products.

A further object of the invention is to provide an apparatus which can be automatically adjusted when the size of holes which are burned into a running web of wrapping material deviates from a desired value.

An additional object of the invention is to provide an apparatus which can be installed in or combined with existing machines for the production of rod-shaped articles which constitute or form part of smokers' products.

A further object of the invention is to provide a perforating apparatus which relies on electric spark discharge and which can make holes whose cross-sectional area is much larger than the cross-sectional area of holes which are obtainable by resorting to conventional apparatus.

The invention is embodied in an apparatus for making holes in webs of wrapping material for cigarettes or other rod-shaped smokers' products, e.g., in cigarette paper or in so-called uniting band material (uniting band material may consist of paper, imitation cork or the like and is coated with adhesive and thereupon severed to yield uniting bands which serve to connect filter plugs with plain cigarettes, cigars or cigarillos). The apparatus comprises means (e.g., one or more sets of driven rolls for advancing a web lengthwise along a predetermined path, a plurality of first electrodes at one side of the path, a plurality of second electrodes at the other side of the path so that each second electrode and a different one of the first electrodes constitutes an electrode pair, means (e.g., a plurality of conductors) for connecting the electrode pairs in series (such series includes a first pair of electrodes and the electrodes of each pair define a spark gap through which the path for the web extends), and means for applying high-voltage impulses to the first electrode of the first electrode pair to thereby induce the flow of a current across the gaps between the electrodes of successive pairs of the series with attendant discharge of electric sparks across the gaps whereby such sparks burn holes in the web which advances along the path.

The connecting means may include conductors which connect the second electrodes of successive electrode pairs with the first electrodes of the next-following pairs of the series so that the discharge of all sparks takes place from the one side to the other side of the path.

Alternatively, the connecting means may comprise conductor means which connect the second electrodes of neighboring pairs and conductor means connecting the first electrodes of neighboring pairs so that the discharge of sparks takes place alternately from the one side to the other side of the path and vice versa.

The pairs of electrodes are preferably equidistant from each other, as considered in the longitudinal direction of the web in the path. In addition (or as an alternative to the just mentioned distribution), successive pairs of electrodes may be offset with respect to each other by identical increments, as cnsidered transversely of the direction of lengthwise movement of the web along the path.

The apparatus may further comprise means for reversing the polarity of high-voltage impulses, either at regular intervals or at random intervals. The electrodes may consist of a material which is used for the manufacture of spark plugs for Otto engines or the like.

Still further, the apparatus may comprise means for varying the combined cross-sectional area of holes per unit length and/or unit area of the web. For example, such varying means may comprise a system for varying the frequency of the application of high-voltage impulses. Alternatively, the varying means may comprise a system for changing the size of holes in the advancing web. Still further, the varying means may comprise a system for changing the number of electrodes which form the series, i.e., for disconnecting one or more electrode pairs from or for connecting one or more electrode pairs to the remaining electrode pairs.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
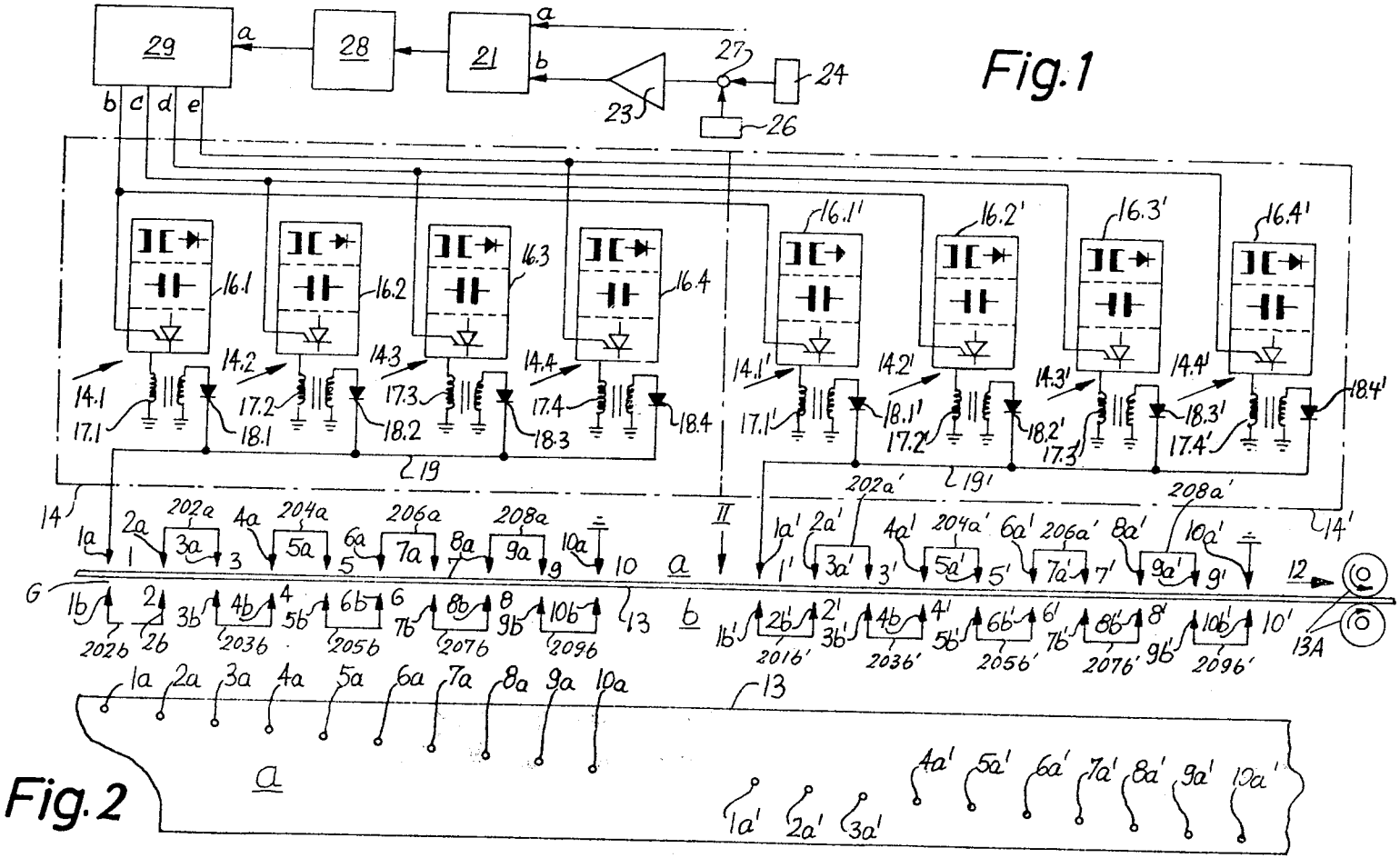
FIG. 1 is a diagrammatic view of a perforating apparatus which embodies one form of the invention and is used to make holes in a running web of cigarette paper or like wrapping material for components of rod-shaped smokers' products.
FIG. 2 is a view as seen in the direction of arrow II in FIG. 1.

The perforating apparatus of FIG. 1 comprises two series or groups of pairwise arranged electrodes which respectively include electrode pairs 1 to 10 and 1' to 10'. The first electrodes 1*a* to 10*a* and 1*a'* to 10*a'* of the respective groups are disposed at one side (a) of a web 13 of wrapping material which is transported along a predetermined path in the direction indicated by arrow 12. The corresponding counterelectrodes or second electrodes 1*b* to 10*b* and 1*b'* to 10*b'* of the respective groups of electrode pairs are disposed at the other side (b) of the running web 13. The electrodes of each pair (e.g., the electrodes 1*a*, 1*b* of the electrode pair 1) are separated from each other by a gap G through which the path of the web 13 extends. This web may consist of a wrapping (uniting band) material, such as cigarette paper or imitation cork, which is used for the making of adhesive-coated uniting bands serving to connect plain cigarettes with filter plugs in a filter tipping machine, e.g., a machine known as MAX S produced by the assignee of the present application. When used for the just mentioned purpose, one side of the web 13 is coated with a suitable adhesive and the web is thereupon severed at regular intervals to yield discrete adhesive-coated uniting bands which are convoluted around portions of plain cigarettes and adjacent filter plugs in a manner well known from the art of making filter cigarettes or other filter tipped rod-shaped smokers' products. It is clear, however, that the web 13 may consist of cigarette paper which is draped around a continuous rod-like filler of shredded tobacco to form therewith a continuous cigarette rod which is thereupon severed by a cutoff to yield a file of discrete plain cigarettes of unit length or multiple unit length. Still further, the web 13 may constitute a strip of wrapping material which is draped around a tow of filamentary filter material to form therewith a continuous filter rod which is severed to yield filter rod sections of desired length, e.g., filter rod sections of six times unit length which are admitted into a filter tipping machine for subdivision into shorter sections capable of being used in the manufacture of filter cigarettes of unit length or double unit length.

All electrodes of the two groups of electrode pairs 1 to 10 and 1' to 10' are connected in series and the electrodes of the two groups are respectively connected with discrete sources 14 and 14' of high-voltage impulses. The sources 14 and 14' respectively comprise parallel-connected impulse generators 14.1 to 14.4 and 14.1' to 14.4'. These impulse generators respectively comprise charging portions for generation of direct-current potential, capacitor portions, thyristorized portions (respectively shown by boxes 16.1 to 16.4 and 16.1' to 16.4') and high-voltage firing coils 17.1 to 17.4 and 17.1' to 17.4' with transformer effect. The coils 17.1 to 17.4 and 17.1' to 17.4' are respectively connected with the electrodes 1*a* and 1*b* by high-voltage diodes 18.1 to 18.4 and 18.1' to 18.4' as well as bus bars 19 and 19'. Circuits which correspond to those represented by boxes 16.1 to 16.4 and 16.1' to 16.4' are marketed by the firm Robert Bosch, Stuttgart, Federal Republic Germany, under the designation "Thyristorzündanlage" (Order No. 0227200 005-000). Coils corresponding to those shown at 17.1 to 17.4 and 17.1' to 17.4' are also marketed by Robert Bosch (Order No. 0221121 005-000).

The means for connecting the electrode pairs 1–10 and 1'–10' in series comprises conductors 202*a*, 204*a*, 206*a*, 208*a*, 201*b*, 203*b*, 205*b*, 207*b*, 209*b* for the electrode pairs 1–10 and conductors 202*a'*, 204*a'*, 206*a'*, 208*a'*, 201*b'*, 203*b'*, 205*b'*, 207*b'*, 209*b'* for the electrode pairs 1'–10'. It will be noted that the neighboring first electrodes (such as 2*a*, 3*a*) are connected to each other, and that the neighboring second electrodes (such as 1*b*, 2*b*) are also connected to each other.

The means for advancing the web 13 lengthwise along the path which extends between the gaps G includes one or more pairs of driven rolls 13A.

FIG. 2 shows that the electrode pairs 1 to 10 and 1' to 10' are equidistant from each other, as considered in the direction of arrow 12, and are also staggered as considered transversely of such direction. The spacing between the electrodes of each group is preferably uniform, and the same applies for the extent to which the electrodes are staggered with respect to each other in a direction at right angles to the direction of forward movement of the web 13. FIG. 2 merely shows the electrodes 1*a* to 10*a* and 1*a'* to 10*a'* at one side (a) of the running web 13.

An advantage of the distribution of electrodes in a manner as shown in FIG. 2 is that a large number of electrodes can be accommodated in a relatively small area. This insures that the rows of holes which are formed in the running web 13 are closely adjacent to each other. Such closeness of rows of holes is desirable in uniting bands which connect filter plugs with plain cigarettes or other tobacco-containing rod-shaped articles. Uniform spacing of electrodes in and transversely of the direction of arrow 12 is desirable and advantageous because it contributes to more uniform distribution of holes in the perforated portion of the web 13. All that counts is to insure that the distance between the neighboring electrode pairs 1–10 and 1'–10' is sufficient to prevent jumping of electric sparks between the neighboring first or second electrodes.

The impulse generators 14.1 and 14.1' receive starting signals in dependency on two control signals which are transmitted to inputs a and b of a multiplying circuit 21. The input a of the circuit 21 receives a signal whose intensity or another characteristic denotes the speed of lengthwise movement of the web 13. As a rule, the rolls 13A advance the web 13 at a constant speed; therefore, the input a of the circuit 21 normally receives a signal of constant intensity.

The input b of the multiplying circuit 21 receives a signal from an amplifier 23 which, in turn, receives such signal from the output of a signal comparing stage 27. The latter compares a reference signal (supplied by a source 24) with a variable signal transmitted by a testing device schematically shown at 26. This testing device may include a drum-shaped conveyor for cigarettes or filter plugs to be tested and serves to ascertain the so-called degree of ventilation of finished filter cigarettes, plain cigarettes or filter rod sections. The degree of ventilation is indicative of the ratio of atmospheric air to tobacco smoke in a column of gaseous fluid which flows into a smoker's mouth. Atmospheric air is admitted via pores of wrapping material which is used in the manufacture of cigarettes and/or through holes or perforations which are formed in the apparatus of the present invention. A testing device which can ascertain the degree of ventilation of cigarettes, filter rod sections or analogous rod-shaped articles which constitute or form part of smokers' products is disclosed, for example, in commonly owned copending application Ser. No. 841,108 filed Oct. 11, 1977 by Günter Wahle et al.

The intensity of signal at the output of the stage 27 depends on the difference between the desired and actual degree of ventilation of articles which are tested by the device 26. Thus, in most instances, the intensity of signal which is transmitted by the output of the multiplying circuit 21 will vary in response to variations of degree of ventilation as ascertained by the testing device 26. Such output signal is transmitted to a voltage-frequency converter circuit 28 which transmits signals to the input a of a counter 29. The frequency of signals which are transmitted to the input a of the counter 29 is proportional to voltage of the signal which is transmitted by the circuit 21.

The counter 29 has four outputs b, c, d and e which are respectively connected with the impulse generators 14.1, 14.1'; 14.2, 14.2'; 14.3, 14.3' and 14.4, 14.4'. These pairs of impulse generators receive starting signals one after the other, i.e., in the order in which the counter 29 transmits signals at the outputs b, c, d and e. Each impulse generator which receives a control signal transmits a high-voltage impulse which is transmitted to the electrode 1*a* or 1*a'* via corresponding bus bar 19 or 19'. Each such impulse initiates the flow of a current which flows from the first electrode 1*a* of the first electrode pair 1 to the second electrode 10*b* of the last electrode pair 10 of the first group or series (via electrodes 1*b*, 2*a*, etc.) or from the first electrode 1*a'* of the first pair 1' to the second electrode 10*b'* of the last pair 10' of the second group or series (via electrodes 1*b'*, 2*a'*, etc.) The flow of current across the gaps G between the electrodes 1*a*–1*b*, 2*a*–2*b*, etc. or 1*a'*–1*b'*, 2*a'*–2*b'*, etc. results in electric spark discharge whereby the sparks burn holes in the respective portions of the web 13. Since the electrode pairs of each group or series are staggered with respect to each other, as considered transversely of the direction of movement of the web 13, and since the electrode pairs 1'–10' are not in register with the electrode pairs 1–10, as considered in the direction of arrow 12, the apparatus provides the web 13 with twenty rows of holes or perforations.

The cross-sectional area of holes (and hence the porosity of the web 13) are a function of frequency of the signal which is transmitted to the input a of the counter 29. Such frequency is normally a function of the measured degree of ventilation of articles which are tested by the device 26, it being assumed that the speed of the web 13 is constant (i.e., that the intensity of the signal which is transmitted to the input a of the multiplying circuit 23 is constant). If the intensity of signal which is transmitted by the testing device 26 deviates appreciably from the intensity of reference signal from the source 24, the intensity of signal which is transmitted by the stage 27 and amplified by 23 and the frequency of signal which reaches the input a of the counter 29 is changed to influence the porosity of the web 13 (by causing the apparatus to make larger or smaller holes) in such a way that the difference between the signals which are transmitted to the stage 27 is reduced, either entirely or to an acceptable value. The arrangement is such that, when the frequency of signal at the input a of the counter 29 increases beyond a certain value, the cross-sectional areas of holes which are formed as a result of generation of sparks between the electrodes of the two groups or series of electrode pairs are increased because the frequency at which the electrode pairs burn holes in the web is much higher than the speed of lengthwise movement of the web. Thus, a second spark is discharged in part through a hole which has been formed by the preceding spark so that the second spark enlarges the hole, the extent to which the hole is enlarged depending on the frequency of signal at the input a of the counter 29. In fact, two, three or more sparks can be discharged through the hole which has been formed by the preceding spark. Thus, the combined cross-sectional area of holes per unit length or unit area of the web 13 can be varied by the testing device 26, namely, by varying the frequency of transmission of high-frequency impulses to the first electrodes 1*a* and 1*a'* of the respective first electrode pairs 1 and 1'.

FIG. 1 shows that the direction of current flow between the electrodes of neighboring pairs of electrodes varies from electrode pair to electrode pair. Thus, while flowing from the electrode 1*a* to the electrode 1*b*, the current flows from the side a to the side b of the web. The flow of current from the electrode 2*b* to the electrode 2*a* is in the opposite direction, i.e., from the side b to the side a of the web 13.

The material of the electrodes 1*a*–10*b* and 1*a'*–10*b'* is preferably identical with or exhibits characteristics similar to those of materials, particularly tungsten, which are used for the manufacture of spark plugs for Otto engines.

An advantage of the aforediscussed means (including the testing device 26) for varying the combined cross-sectional area of holes per unit length or unit area of the web 13 is that such means allows for highly accurate regulation of the degree of ventilation. Thus, all that is necessary is to ascertain the degree of ventilation of the finished products which contain portions of the perforated web 13 and to thereupon vary the diameters of holes in dependency on deviations of the measured degree of ventilation from a predetermined value (denoted by the reference signal from the source 24). Continuous adherence to desired or optimum degree of ventilation is particularly important in so-called light cigarettes. Such cigarettes invariably comprise wrappers having holes for admission of atmospheric air into the column of tobacco smoke. As described above, the combined cross-sectional area of holes per unit length or unit area of the web 13 can be varied by changing the frequency of application of high-voltage impulses to the electrodes 1*a* and 1*a'*. If the frequency is increased to a certain limit, the apparatus increases the number of holes per unit length or unit area of the web 13. If the frequency is increased beyond such limit, the apparatus increases the diameters of the holes. In the latter instance, the frequency of application of high-voltage impulses is sufficiently high to insure that the intervals between successive spark discharges are extremely short (as compared with the speed of lengthwise movement of the web 13) so that the hole which is formed by a preceding spark between a pair of electrodes is enlarged by the next-following spark which is discharged between the same pair of electrodes.

The provision of means for varying the combined cross-sectional area of holes per unit length or unit area of the web 13 is desirable even if the initial porosity of the web (i.e., upstream of the first electrode pair 1) is constant or practically constant. The degree of ventilation can be influenced by parameters other than initial porosity of the web, e.g., due to the nature of manipulation of tobacco and web or webs in the manufacture of plain or filter tipped cigarettes or other smokers' products. Moreover, the varying means of FIG. 1 can compensate for variations in forward speed of the web 13.

The frequency of conventional sources of high-voltage impulses which can furnish currents of required strength is normally limited. The provision of several impulse generators which are connected in parallel overcomes such problem, i.e., the frequency of spark discharge can be increased by the simple expedient of energizing one high-voltage source after the other.

Another important advantage of the improved apparatus is that the web 13 is formed with holes of predictable size and shape. Furthermore, and since the combined length of the group or series of electrode pairs 1–10 or 1'–10' is considerable (as viewed in the direction of arrow 12), it is possible to apply high voltage which results in the making of relatively large holes, i.e., of holes which are larger than those which are obtained when the relatively low voltages are applied to the first electrodes of one or more groups of series of electrodes.

Figure 3:
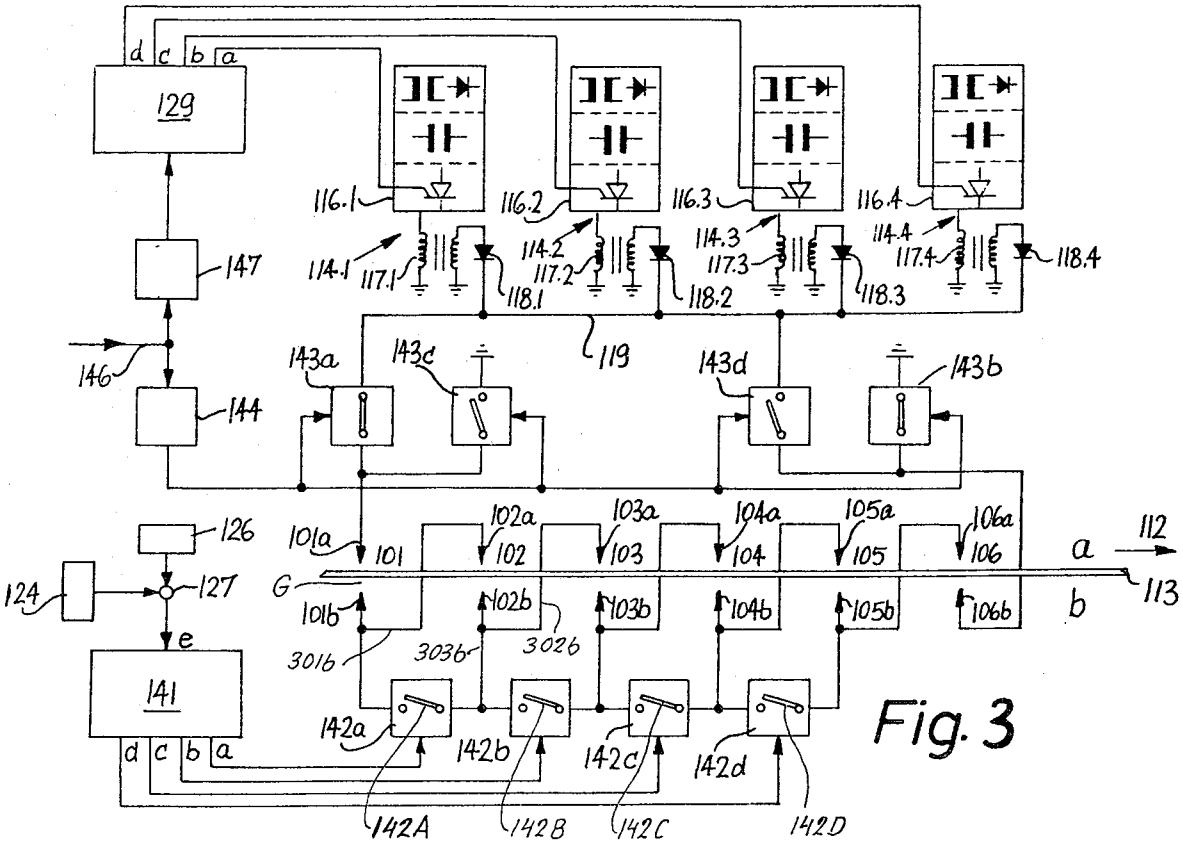
FIG. 3 is a diagrammatic view of a modified perforating apparatus.

The perforating apparatus of FIG. 3 differs from the apparatus of FIG. 1 in that the cross-sectional areas of holes can be varied in a different way, namely, by disconnecting one or more electrode pairs from the source (or respective sources) of high-voltage impulses. All such parts of the apparatus of FIG. 3 which are identical with or clearly analogous to corresponding parts of the perforating apparatus of FIG. 1 are denoted by similar reference characters plus 100. For the sake of simplicity, the apparatus which is shown in FIG. 3 comprises a single group or series of six electrode pairs 101 to 106 having first electrodes 101*a* to 106*a* at the side a and second electrodes 101*b* to 106*b* at the side b of the running web 113. The perforating apparatus of FIG. 3 further comprises means for intermittently or regularly reversing the polarity of high-voltage impulses to thus prevent accumulations of paper fragments at the tips of the electrodes, namely, of fragments which are removed from the web 113 as a result of spark discharge across the gaps G between the electrodes 101*a*–101*b*, 102*a*–102*b*, etc.

The signal comparing stage 127 receives signals from the testing device 126 and from a source 124 of reference signals denoting the desired degree of ventilation of articles which are tested at 126. If the signal from 126 (actual degree of ventilation) deviates from the reference signal, the stage 127 transmits a signal to the input e to a control circuit 141, e.g., a threshold circuit with four outputs a, b, c and d. The outputs a to d of the threshold circuit 141 are respectively connected with discrete high-voltage relays 142*a*, 142*b*, 142*c*, 142*d*. If a relay receives a signal from the respective output of the circuit 141, it closes its relay switch (142A, 142B, 142C, 142D) to short-circuit the next-following electrode. For example, if the relay 142*a* closes its switch 142A, current can flow from the electrode 101*b* of the first electrode pair 101 directly to the electrode 103*a* of the third electrode pair 103 (via conductor 303*b*) whereby the electrode pair 102 is disconnected. Thus, the effective number of electrode pairs is reduced to five. Analogously, simultaneous transmission of signals to the relays 142*a*, 142*b* results in disconnection of electrode pairs 102 and 103. A total of four out of six electrode pairs can be disconnected by closing the switches of all four relays 142*a*–142*d*. This results in a corresponding reduction of the number of holes and in reduced porosity of the web 113. The porosity of the web 113 is increased by reducing the number of disconnected electrode pairs to three, two, one or zero. The arrangement is such that, if the difference between the intensities of signals which the stage 127 receives from the testing device 126 and from the source 124 of reference signals is small, the threshold circuit 141 transmits a signal via a single output, e.g., via output a to disconnect the electrode pair 102. If the difference between the measured and desired degrees of ventilation is more pronounced (i.e., if the degree of ventilation is much higher than desired), the stage 127 causes the circuit 141 to transmit two, three or four signals to thereby deactivate a corresponding number of electrode pairs and reduce the number of holes per unit area of the web 113. It will be recalled that the electrode pairs 101–106 are preferably staggered with respect to each other, as considered transversely of the direction (arrow 112) of forward movement of the web 113, so that disconnection of each pair of electrodes results in a reduction of the number of rows of holes which are formed by the sparks.

In the embodiment of FIG. 3, the flow of current across the web 113 is always in the same direction, i.e., from the side a toward the side b of the web. This is due to the fact that the electrode 101*b* at the side b is connected (via conductor 301*b*) with the electrode 102*a* at the side a, that the electrode 102*b* at the side b is connected (via conductor 302*b*) with the electrode 103*a* at the side a, and so forth.

Periodical reversal of polarity of high-voltage impulses which are transmitted to the bus bar 119 is achieved by the provision of four high-voltage relays 143*a*, 143*b*, 143*c*, 143*d*. Of these, the condition of two relays (namely, the relays 143*a*, 143*b* and 143*c*, 143*d*) is always the same. The condition of these relays is changed in response to signals from a control circuit 144 whereby the relays 143*a*–143*d* reverse the polarity of impulses which are transmitted to the electrodes 101*a*–106*a*. The control circuit 144 receives signals via conductor means 146 which, in turn, receives signals from the customary pulse generator of the machine which processes the web 113, i.e., a filter tipping machine if the web 113 is used for the making of adhesive-coated uniting bands. The conductor means 146 transmits a signal in response to each severing of the web 113, i.e., the arrangement of FIG. 3 can reverse the polarity of high-voltage impulses at the rate at which the machine produces filter cigarettes of unit length or double unit length.

The signal from conductor means 146 is further transmitted to a frequency multiplying circuit 147 and thence to the counter 129 whose outputs a to d are connected with the corresponding impulse generators 114.1 to 114.4. The signals from the counter 129 serve the same purpose as described in connection with the counter 29 and impulse generators 14.1 to 14.4 of the perforating apparatus of FIG. 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for making holes in a web of wrapping material for cigarettes or other rod-shaped smokers' products, comprising means for advancing the web lengthwise in a predetermined direction along a predetermined path; a plurality of first electrodes at one side of said path; a plurality of second electrodes at the other side of said path, each of said second electrodes and a different one of said first electrodes constituting an electrode pair; means for connecting said pairs in series, said series including a first pair of electrodes and the electrodes of each pair defining a spark gap through which said path extends; means for applying high-voltage impulses to the first electrode of said first pair to thereby induce the flow of current across the gaps between the electrodes of successive pairs of said series with attendant discharge of electric sparks across said gaps whereby such sparks burn holes in the web which advances along said path; and means for varying the combined cross-sectional area of holes per unit length of the web, including means for generating first signals denoting the porosity of the web downstream of said gaps, as considered in said direction, means for generating a reference signal denoting the desired porosity of the web, and means for changing the combined cross-sectional area of holes per unit length of the web when said first signals deviate from said reference signal.

2. Apparatus as defined in claim 1, wherein said connecting means includes conductors connecting the second electrodes of successive pairs with the first electrodes of the next-following pairs of said series so that the discharge of all sparks takes place from said one side to said other side of said path.

3. Apparatus as defined in claim 1, wherein said connecting means comprises conductors connecting the second electrodes of neighboring pairs and conductors connecting the first electrodes of neighboring pairs so that the discharge of sparks takes place alternately from said one to said other side of said path and vice versa.

4. Apparatus as defined in claim 1, wherein said pairs of electrodes are equidistant from each other, as considered in the longitudinal direction of the web in said path.

5. Apparatus as defined in claim 1, wherein said successive pairs of electrodes of said series are offset with respect to each other by identical increments, as considered transversely of the direction of lengthwise movement of the web along said path.

6. Apparatus as defined in claim 1, further comprising means for reversing the polarity of said impulses.

7. Apparatus as defined in claim 1, wherein the electrodes of said pairs consist of tungsten.

8. Apparatus as defined in claim 1, wherein said changing means comprises means for changing the frequency of application of said impulses.

9. Apparatus as defined in claim 1, wherein said changing means comprises means for changing the size of holes in the advancing web.

10. Apparatus as defined in claim 1, wherein said changing means comprises means for changing the number of electrodes which form said series.

11. Apparatus as defined in claim 1, wherein said means for generating said first signals includes means for generating signals denoting the porosity of wrappers of rod-shaped smokers' products.

12. Apparatus as defined in claim 1, wherein said web consists of cigarette paper.

13. Apparatus as defined in claim 1, wherein said web consists of a uniting band material.

14. Apparatus as defined in claim 1, wherein said means for applying high-voltage impulses comprises a plurality of discrete impulse generators and means for connecting said impulse generators to the first electrode of said first pair in a predetermined sequence.

* * * * *